US006396367B1

(12) United States Patent
Rosenberger

(10) Patent No.: US 6,396,367 B1
(45) Date of Patent: May 28, 2002

(54) COAXIAL CONNECTOR

(75) Inventor: Bernhard Rosenberger, Tittmoning (DE)

(73) Assignee: Rosenberger Hochfrequenztechnik GmbH & Co., Tittmoning (DE)

( * ) Notice: Subject to any disclaimer, the term of this patent is extended or adjusted under 35 U.S.C. 154(b) by 0 days.

(21) Appl. No.: 09/553,358

(22) Filed: Apr. 21, 2000

(30) Foreign Application Priority Data

Apr. 22, 1999 (DE) ..... 299 07 173 U

(51) Int. Cl.[7] ..... H01P 1/04

(52) U.S. Cl. ..... 333/260; 439/578

(58) Field of Search ..... 333/254, 260; 439/578

(56) References Cited

U.S. PATENT DOCUMENTS 3,496,496 A * 2/1970 Fiebel et al. ..... 333/33
4,957,456 A * 9/1990 Olson et al. ..... 439/578

FOREIGN PATENT DOCUMENTS

DE 43 00 243 C1 3/1994
DE 43 29 892 C1 3/1994
GB 2 274 217 A 7/1994

OTHER PUBLICATIONS

Neubauer, H. et al, Koaxiale Prazisionsstecker, Bemessungsgrundlagen und deren Realisierung im Zwitterstecker "Precifix". In: Rohde & Schwarz–Mitteilungen, H. 19, 1965, S. 186–194.

* cited by examiner

*Primary Examiner*—Robert Pascal
*Assistant Examiner*—Dean Takaoka
(74) *Attorney, Agent, or Firm*—Lowe Hauptman Gilman & Berner, LLP

(57) ABSTRACT

A coaxial connector comprises an outer conductor having an inner diameter D, an inner conductor coaxial with the outer conductor and having an outer diameter d, and an insulating structure having pluralradii between the conductors. The diameters are selected in such a manner that the connector has a predetermined characteristic impedance $$Z_0 = \frac{60}{\sqrt{\epsilon_r}} \ln\left[\frac{D}{d}\right].$$

The connector has a first cable side for connection to a coaxial cable and a second connection side for connection to a corresponding coaxial connector. The insulating structure is one piece, including a disk and tube, together having a bore with a diameter less than d. The inner conductor is inserted into the bore of the tube that is mounted in proximity to the second end. The disk periphery is fixedly mounted against the inner wall of the outer conductor. The portion of the inner conductor in the bore and the bore have a smaller diameter than d to compensate for the dielectric properties of the insulating structure in such manner that the connector has the predetermined characteristic impedance $Z_0$ where the insulating structure is located. The structure radii are selected as a function of the structure dielectric constant $\epsilon$ in such manner that the predetermined characteristic impedance $Z_0$ wave equation is attained.

23 Claims, 5 Drawing Sheets

COAXIAL CONNECTOR

FIELD OF INVENTION

The present invention relates generally to coaxial connectors, whether male or female and, more particularly, to a connector including an insulating structure having plural radii between coaxial inner and outer conductors, wherein (1) the insulating structure receives the inner conductor in an opening having a smaller diameter than a standard inner conductor diameter and (2) the connector has a predetermined characteristic impedance $$Z_0 = \frac{60}{\sqrt{\epsilon_r}} \ln\left[\frac{D}{d}\right],$$

where $\epsilon_r$ is the dielectric constant of an insulator between the conductors, d is the outer diameter of the standard inner conductor and D is the inside diameter of the outer conductor.

BACKGROUND ART

In accordance with German DIN standard 47 223, a 7/16 coaxial connector has an outside diameter (d) of an inner conductor of about 7 mm and an inside diameter D of an outer conductor of about 16 mm. With air as the dielectric between the inner and outer conductors, such a connector, whether male or female, has a constant characteristic impedance of 50 Ω. The family of 7/16 coaxial connectors, whether male or female, is appropriate to connect tubular coaxial conductors and flexible cables preferably having an outer conductor with an effective inside diameter between 10 mm and 20 mm. Such connectors usually include an insulating disk to support and brace the inner conductor within the outer conductor. The insulating disk supports a bush-shaped inner conductor of a female coaxial connector and a pin-like inner conductor of a male coaxial connector. The insulating disk is made of an insulator material having a dielectric constant $\epsilon_r$ enabling the connector to have a characteristic impedance $$Z_0 = \frac{60}{\sqrt{\epsilon_r}} \ln\left[\frac{D}{d}\right]$$

to satisfy the wave equation.

Because the dimensions of d=7 mm and D=16 mm are selected for air as the dielectric between the inner and outer conductors, the inner conductor must have a smaller diameter in the vicinity of the disk in order for the wave equation to provide the desired 50 Ω characteristic impedance. For that reason the inner conductor of a 7/16 coaxial connector per DIN 47 223 is constricted in the vicinity of the insulating disk. On both sides of the insulating disk, that is on both sides of the constriction, the inner conductor has a standard 7 mm outside diameter. The constriction of the inner conductor diameter is a substantial drawback to use of 7/16 coaxial connectors having insulating disks, because of the complexity encountered in manufacturing and assembling such coaxial connectors. It is impossible simply to push the inner conductor through the insulating disk.

Accordingly, an object of the present invention is to provide a new and improved coaxial connector having a solid dielectric separating the connector inner and outer conductors, wherein the dielectric is made to simplify manufacture and assembly of a functionally reliable connector without changing the connector characteristic impedance.

SUMMARY OF THE INVENTION

A coaxial connector in accordance with the invention comprises an outer conductor (having an inner diameter D), an inner conductor (having an outer diameter d) coaxial with the outer conductor, and an insulating structure between the conductors. The diameters are selected in such a manner that, according to the wave equation, a predetermined characteristic impedance $$Z_0 = \frac{60}{\sqrt{\epsilon_r}} \ln\left[\frac{D}{d}\right]$$

is attained. The connector has a first cable side adapted to be connected to a coaxial cable and a second connection side adapted to be connected to a corresponding coaxial connector. The insulating structure has a dielectric constant $\epsilon$ and is mounted in proximity to the second end and remote from the first end. The insulating structure has a substantial length along the longitudinal axis of the inner conductor and includes a first portion that is fixedly mounted relative to the outer conductor. The insulating structure includes an opening through which the inner conductor passes. The opening has a smaller diameter than d, as does the outer diameter of the portion of the inner conductor which passes through the opening.

The insulating structure has differing radii between the inner and outer conductors along its length. The insulating structure radii, the opening diameter and the insulating structure dielectric constant $\epsilon_r$ are such that the predetermined characteristic impedance $Z_o$ of the wave equation is attained where the insulating structure is located to compensate for the dielectric properties of the insulating structure.

Preferably, the insulating structure includes a first disk like portion and a second portion extending from the disk like portion toward the second end. The first portion has a constant diameter equal to D, while the second portion has a constant diameter between d and D. Preferably, the diameter of the second portion is less than D/2.

The insulating structure is preferably constructed in such a manner that the reduced diameter inner conductor does not include a constriction at the connection-side of the insulator structure. As a result, the coaxial connector can be assembled in a simple manner by merely pushing the inner conductor through the insulator. The values of d and D of the coaxial connector make it possible to connect the connector, without need for compensation, in the region of an electrical or mechanical reference plane to a standard d/D coaxial connector. Moreover, despite the reduced outer diameter of the inner conductor at the connection-side end of the insulating disk, relative to the standard inner conductor diameter, d, the inside diameter D of the outer conductor is unchanged at the connection-side end of the coaxial connector. As a result no jump occurs when a coaxial connector of the present invention is connected to a cable having the standard values of d and D or to another connector having an insulating structure in accordance with the invention. Such a connection between the outer conductor of the connectors defines both a mechanical and an electrical reference plane. Because no jump occurs no compensation is necessary to attain the predetermined characteristic impedance $Z_0$.

In one embodiment, the coaxial connector is a male coaxial connector with an inner conductor in the form of a pin. The insulating structure is fixed in place at the connection-side end of the connector in a stable and very easily implemented manner in such a male coaxial connector. The connector outer conductor includes a metal ring abutting the insulating structure. The metal ring outer diameter is the same as the outer conductor inner diameter. The metal ring is preferably a press-fitted metal ring, extending between the insulating structure and an electrical and mechanical reference plane formed by an interface between the outer-conductors of the male connector and a mating female connector. The female connector preferably has an insulating structure similar to the male connector or a convention female connector of an end of a coaxial cable. In another embodiment, the coaxial connector is a female connector having a bush-shaped inner conductor having a connection interface region with a mating male connector. The interface region of the bush-shaped inner conductor includes slits circumferentially distributed over the interface. The slits form an elastic chuck. This design offers the particular advantage that the slitted portion of the inner conductor bears against a wall defining the inner diameter of a second portion of the insulating structure having an outer diameter less than D, and preferably less than D/2.

The insulating structure wall braces the chuck segments. If the female connector is connected to a male connector in such a way that the male and female connectors are not exactly aligned, bending or breaking of the chuck segments does not occur, even though the chuck segments have a thinner wall relative to a standard female connector because of support for the chuck segments the wall provides.

Appropriately, the coaxial connector is a 7/16 coaxial connector, illustratively a 7/16 coaxial female connector or a 7/16 coaxial male connector having a characteristic impedance $Z_0$=50 Ω. Many high-frequency applications are covered, for instance mobile-radio base stations, where the desired characteristic impedance $Z_0$=50 Ω.

The above and still further objects, features and advantages of the present invention will become apparent upon consideration of the following detailed descriptions of plural specific embodiments thereof, especially when taken in conjunction with the accompanying drawings.

DETAILED DESCRIPTION OF THE DRAWINGS

Figure 1:
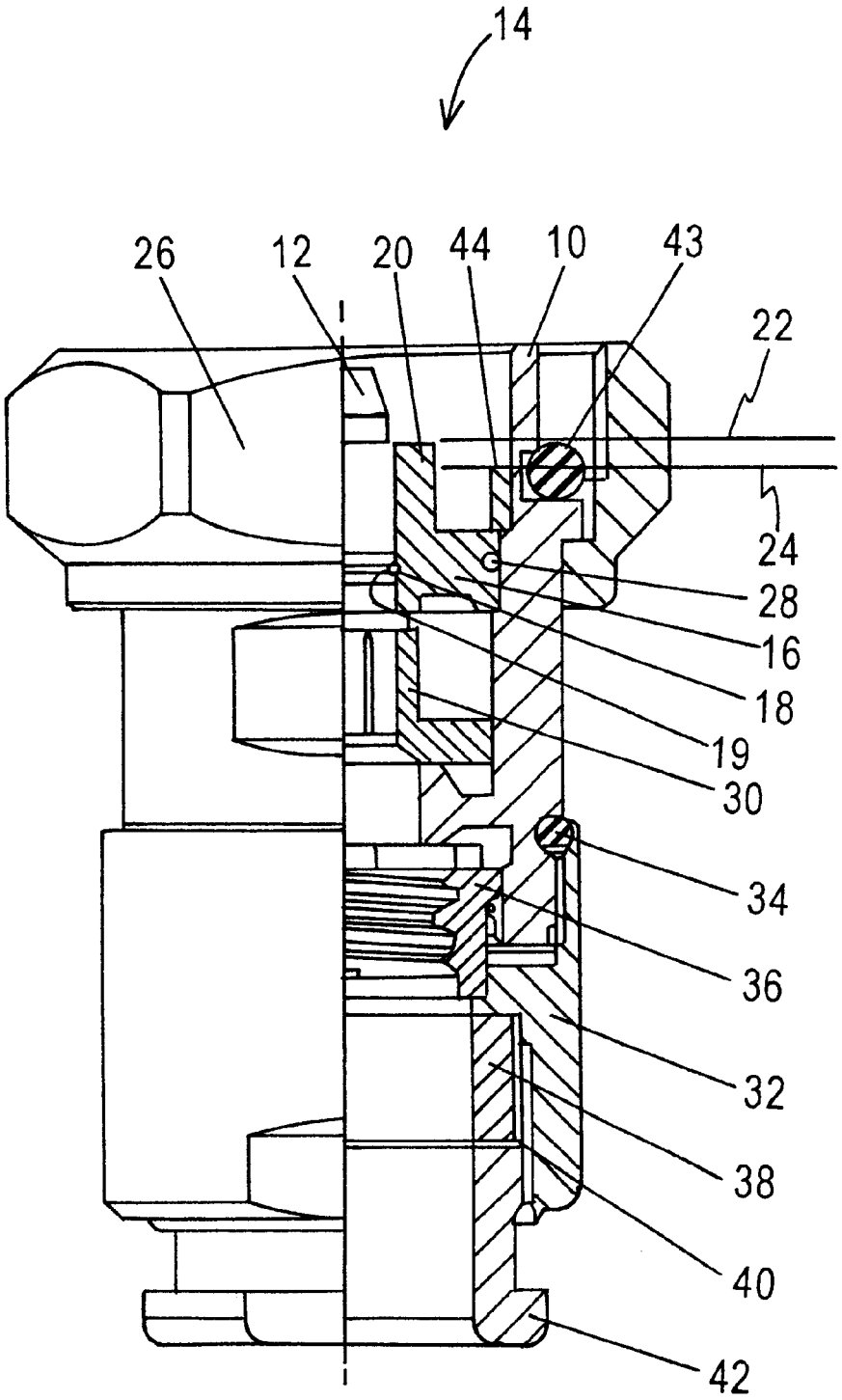
FIG. 1 is a sideview, partly in section, of a first preferred embodiment of the invention in the form of a straight male coaxial connector.

The coaxial connector shown in FIG. 1 is a male coaxial connector including an outer conductor 10, and a pin-shaped inner conductor 2 coaxial with outer conductor 10. The connector of FIG. 1 includes a connection-side end 14 adapted to be connected to a corresponding coaxial connector and an insulating disk 16 mounted in proximity to connection-side end 14 to support inner conductor 12. The illustratively shown coaxial connector of FIG. 1 is a type 7/16, that is, the outside diameter d of inner conductor 12 is about 7 mm with air being the dielectric, and the inside diameter D of the outer conductor 10, again with air as the dielectric, is about 16 mm With air the dielectric, the connector of FIG. 1 has a characteristic impedance $Z_0$=50 Ω. Because a material other than air is present in the portion of the connector where insulating disk 16 extends between inner conductor 12 and outer conductor 10, the outer diameter of the inner conductor 12 and hence of borehole 18 in insulating disk 16 through which she inner conductor passe must be smaller in diameter than 7 mm to maintain the 50 Ω characteristic impedance.

The segment of inner conductor 12 which extends along the common longitudinal axes of the connector, as well as the inner and outer conductors, and in borehole 18 of the insulating disk 16 toward connection-side end 14, has a reduced diameter compared to the 7 mm outer diameter of the remainder of the inner conductor. The electric insulating structure including disk 16 also includes tube 20, having a circular cross-section bore having a diameter aligned with and equal to the diameter of the bore in disk 16. Inner conductor 12 passes through the aligned bores in the centers of tube 20 and disk 16. Disk 16 and tube 20 are an integral, one piece structure, made of the same dielectric material, having a dielectric constant $\epsilon_r$. Tube 20 extends from a face of disk 16 toward connection-side end 14 in such manner that the dielectric tube 20 overlaps the inner conductor 12 as far as interface 22 of the inner conductor 12. Interface 22 of the inner conductor 12 denotes that plane at which the inner conductor of the male coaxial connector of FIG. 1 comes to rest against the inner conductor of another female coaxial connector, e.g., the female connector of FIG. 2. Hence, the inner conductors of the mating male and female connectors are connected at interface 22. The female connector of FIG. 2 has a corresponding end face with a bush-shaped inner conductor that bears against interface 22.

Accordingly, a contact plane between the outer conductors of joined male and female coaxial connectors forms an outer-conductor interface which determines a plane that is defined both as an electrical and a mechanical reference plane 24. According to DIN standard 47 233, the interface plane 22 of the inner conductor 12 of the male and female coaxial connectors projects 1.77 mm beyond electrical and mechanical reference plane 24 (FIG. 2).

The male coaxial connector of FIG. 1 also comprises coupling nut 26, O-ring 28 that seals the insulating disk 16 from outer conductor 10, insulator 30 in a cable entry region, housing 32, seal 34 to seal housing 32, locking ring 36 for the outer conductor of a coaxial cable to be inserted into the connector, sealing element 38, seat 40 for sealing element 38, packing 42 and O-ring 43 that seals the zone of the coupling nut 26. Press-fitted ring 44 holds insulating disk 16 in the connection-side end 14 of the coaxial connector and forms the outer conductor between the insulating disk 16 and the electrical and mechanical reference plane 24.

Figure 2:
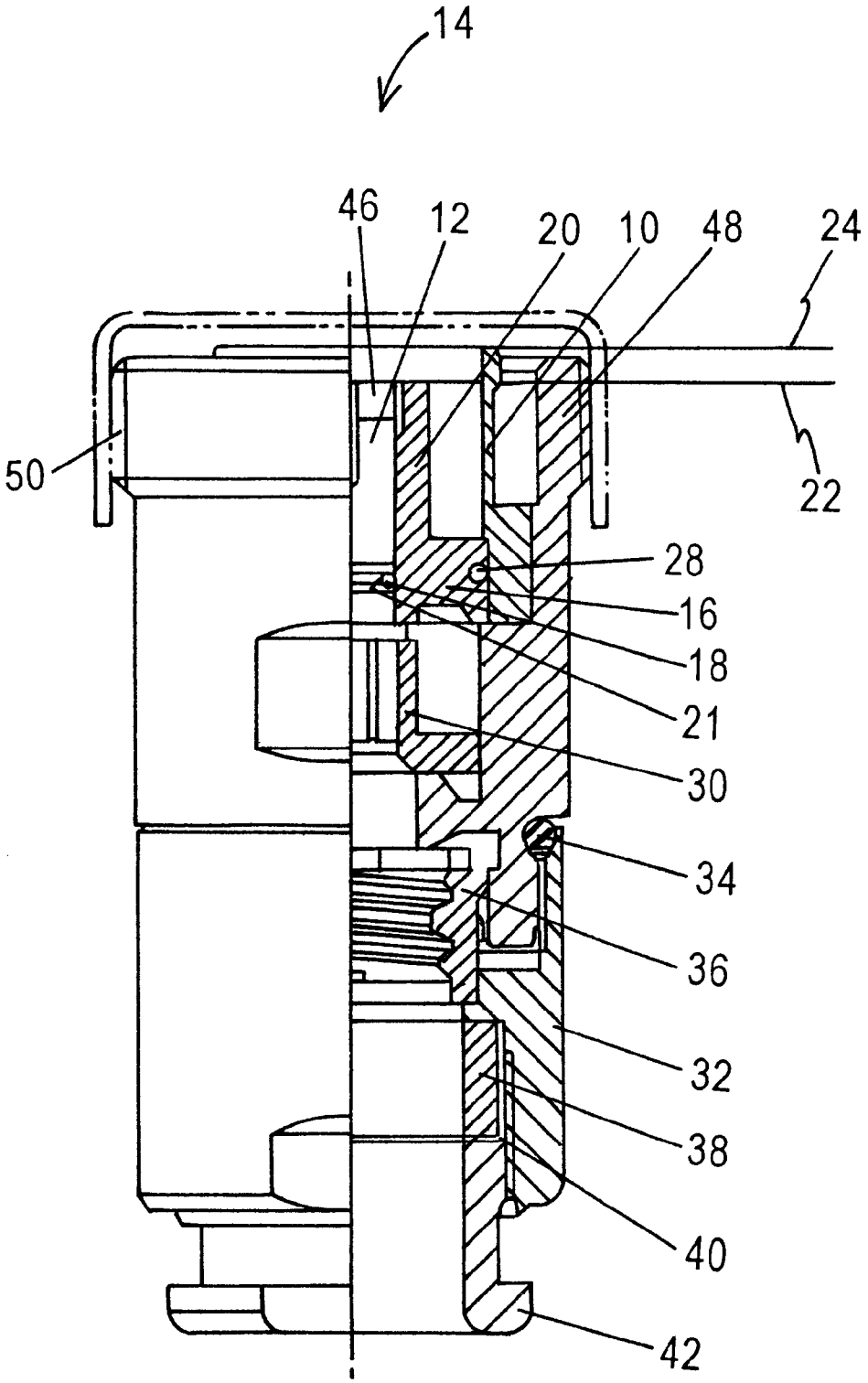
FIG. 2 is a sideview, partly in section, of a second preferred embodiment of the invention in the form of a straight female coaxial connector.

The female 7/16 coaxial connector shown in FIG. 2 includes a bush-shaped inner conductor 12. Contrary to the case of the male connector of FIG. 1, the inner conductor 12 of FIG. 2 is configured like a bush including appropriate axial slits in the connection-side end. The slits in inner conductor 12 constitute a chuck with corresponding segments. The female coaxial connector of FIG. 2 includes an insulating structure having the same configuration as the insulating structure of FIG. 1 and thus comprises disk 16 and additional tube 20. Dielectric tube 20 also overlaps the chuck segments 46, whereby the additional dielectric tube 20 constitutes a support for segments 46. Accordingly, if the male coaxial connector of FIG. 1 is inserted in less than exact alignment into the female coaxial connector of FIG. 2, chuck segments 46 are not bent or broken because the chuck segments are additionally supported by the interior wall of dielectric tube 20 against which the chuck segments bear.

In FIG. 2, electric and mechanical reference plane 24 projects about 1.77 mm above interface plane 22 of inner conductor 12. In the female connector of FIG. 2, press fitted ring 44 and coupling nut 26 of the male connector are not needed and are replaced at connection side end 14 by housing 48 having metal thread 50 for receiving a threaded flange at the end of the male connector inserted into end 14.

Figure 3:
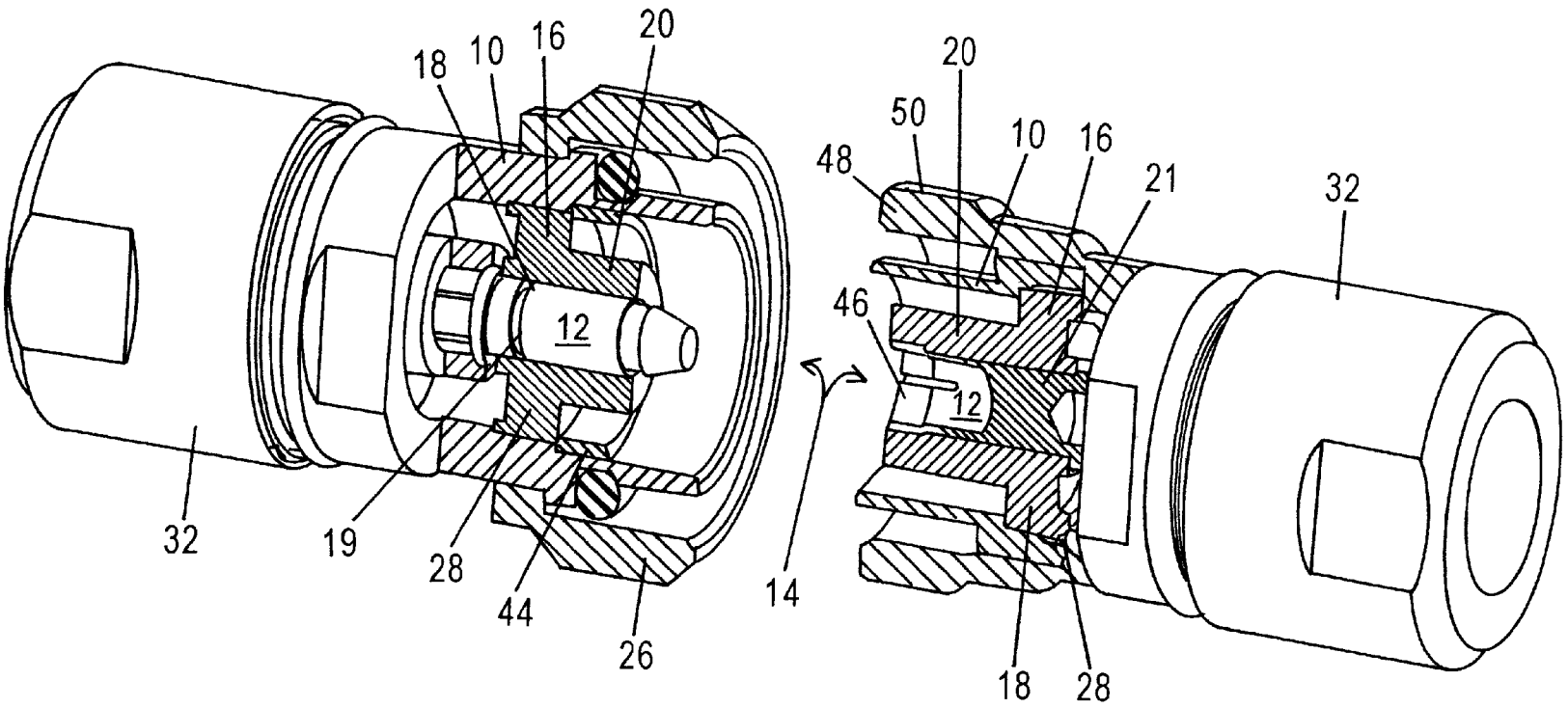
FIG. 3 is a partly sectional, perspective view of matched male and female coaxial connectors illustrated in FIGS. 1 and 3 before being connected.
Figure 4:
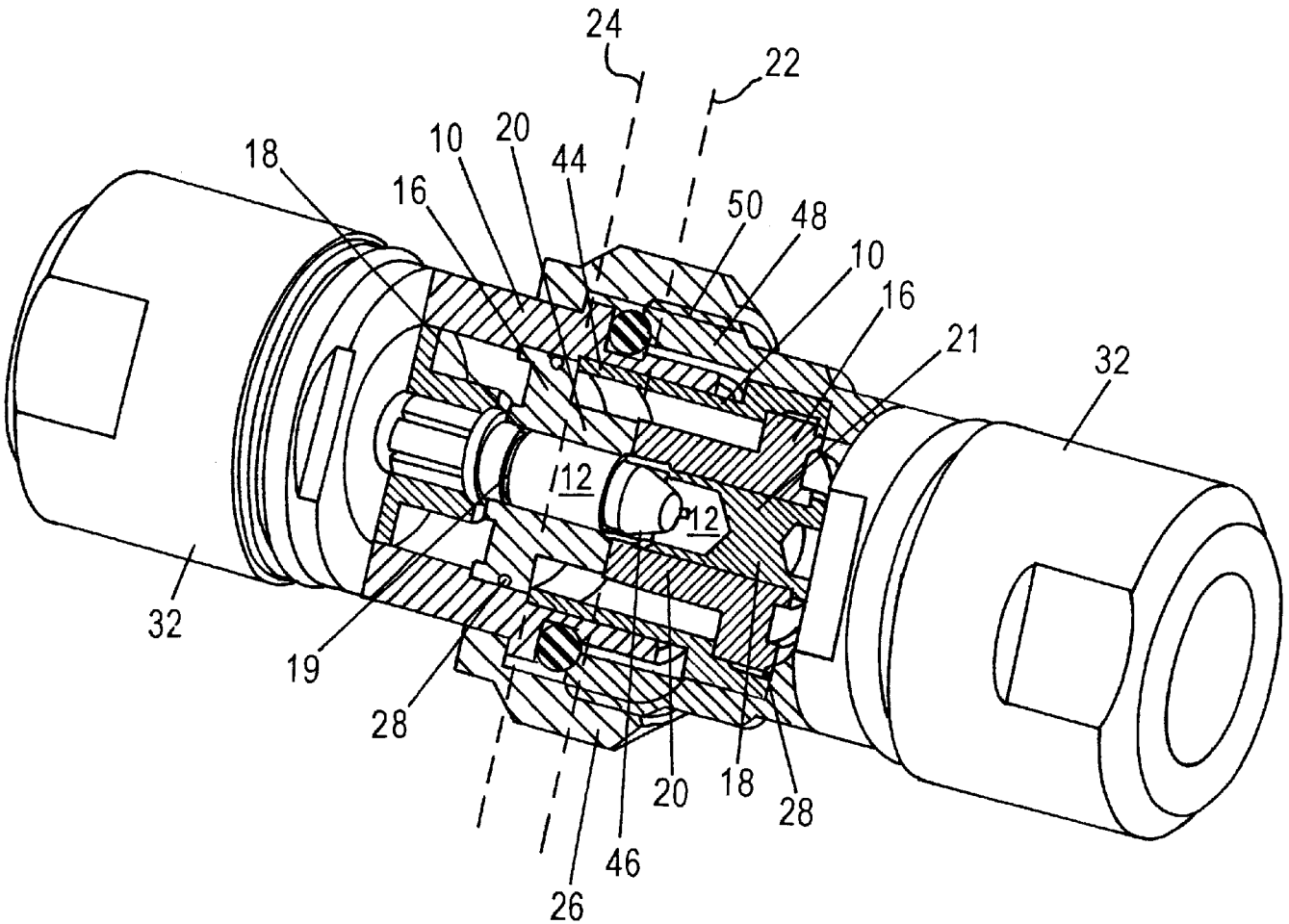
FIG. 4 is a partly sectional, perspective view of the structure illustrated in FIG. 3 when the male and female connectors are connected.

FIGS. 3 and 4 are perspective, partially sectional diagrams of the male and female coaxial connectors of FIGS. 1 and 2 before and after the male connector has been inserted into the female connector. The end faces of dielectric tube portions 20 and the inner conductors 12 of the male and female connectors of FIGS. 1 and 2 meet and abut at interface 22, FIG. 4. The outer conductors 10 of the male and female connectors meet and abut in electrical and mechanical reference plane 24. The inner diameters of the outer conductors of the male and female connectors are the same (equal to D). In contrast, the outer diameters of the inner conductors within disk portion 16 and tube 20 portion of the insulating structure of the male and female connectors are slightly less than d. As shown especially clearly in FIG. 4, in order to preserve a constant characteristic impedance $Z_0$=50 Ω, this design requires no compensation or jump in the region of the outer conductor or in the region of the electrical and mechanical reference plane 24.

Figure 5:
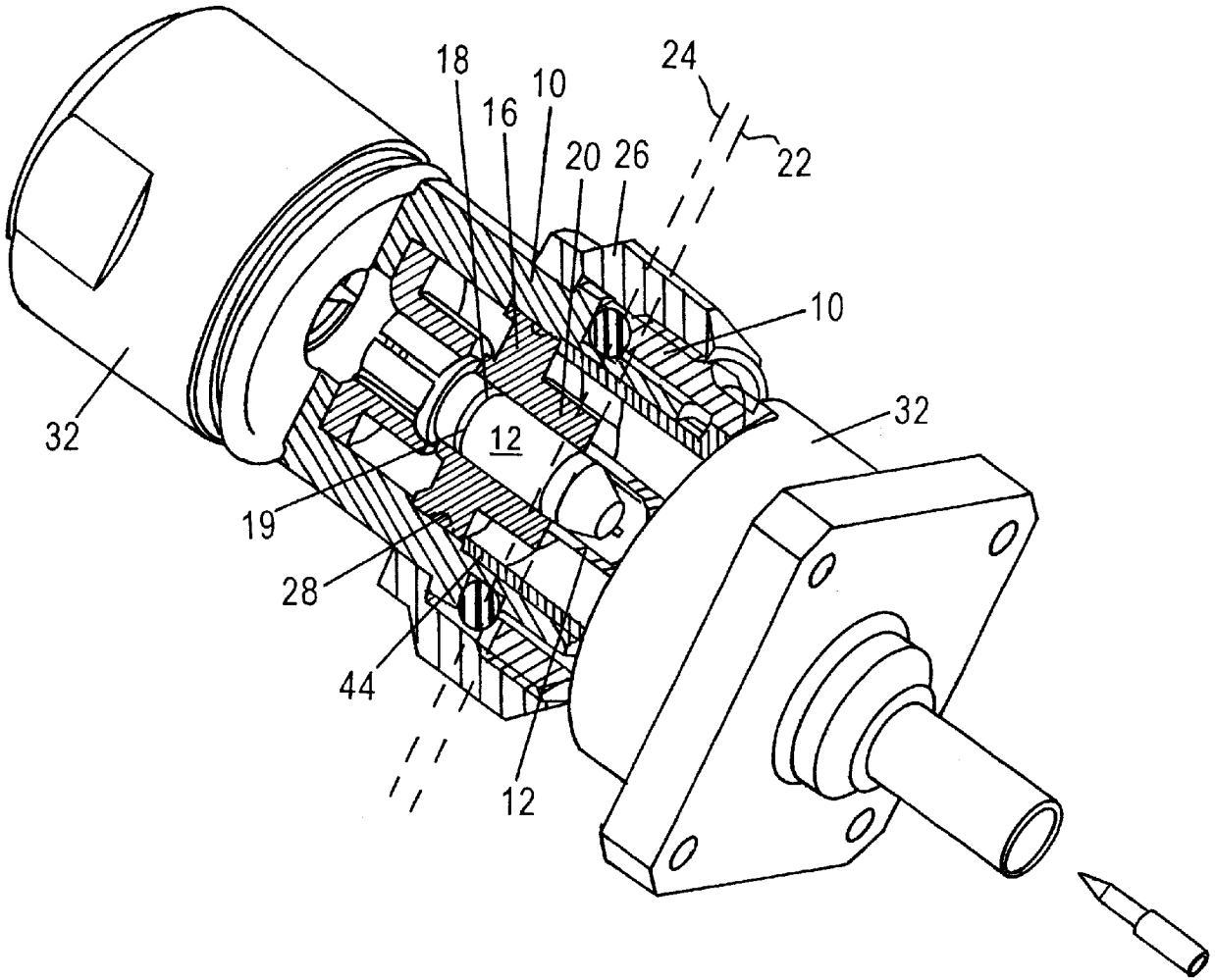
FIG. 5 is a partly sectional, perspective view of a male coaxial connector of the type illustrated in FIG. 1, when connected to a conventional, standard female coaxial connector.

FIG. 5 is a perspective, partially sectional diagram of a 7/16 male coaxial connector of FIG. 1 joined to a conventional prior art female connector according to DIN 47 223. In FIG. 5 the transition between the outer conductors of the male and female connectors takes place free of any jump or any compensatory design in electrical and mechanical reference plane 24. Accordingly, the male coaxial connector of the invention is wholly compatible with conventionally manufactured DIN 47 223 female coaxial connectors. This compatibility also applies reversely to the female coaxial connector of FIG. 2 and male coaxial connectors of the prior art. Because there is freedom from compensation or jumps in the region of the outer conductors, that is in the electrical and mechanical reference plane 24, the cutoff frequency of these male and female connectors, in spite of the non-standard dimensions of the inner conductors thereof, is not significantly reduced. This feature also applies in particular when a male or female connector of the invention is being joined to a prior art standard-configuration female or male connector. Moreover, the design of the invention offers greater handling reliability because the chuck segments of lower wall thickness are not at risk of breaking, as discussed above.

Another feature of the invention, shown in particular in FIGS. 3 through 5, is the inclusion of O-rings 19 and 21, respectively mounted for sealing purposes in borehole 18 of the insulating disk 16 of the male and female connectors for sealing purposes.

Wile there have been described and illustrated plural specific embodiments of the invention, it will be clear that variations in the details of the embodiments specifically illustrated and described may be made without departing from the true spirit and scope of the invention as defined in the appended claims.

I claim:

1. A coaxial connector comprising an outer conductor having an inner diameter D, an inner conductor coaxial with said outer conductor and having an outer diameter d, the diameters being such that, according to the wave equation, the connector has a predetermined characteristic impedance $$Z_0 = \frac{60}{\sqrt{\epsilon_r}} \ln\left[\frac{D}{d}\right]$$

where $\epsilon_r$ is the dielectric constant of an insulator between the conductors, the connector having a first side adapted to be connected to a coaxial cable and a second side to be adapted to be connected to a corresponding coaxial connector, an insulating structure having a dielectric constant $\epsilon$ mounted in proximity a the second end and remote from the first end, the structure having a substantial length along the longitudinal axis of the inner conductor, the structure including a first portion that is fixedly mounted relative to the outer conductor, the structure including an opening through which the inner conductor passes, the portion of the inner conductor passing through the opening having a smaller diameter than d to compensate for the dielectric properties of the insulating structure in such manner that the connector has the predetermined characteristic impedance $Z_0$ where the insulating structure is located, the diameter of the inner conductor corresponding to the reduced diameter of the opening of the insulating structure, the structure having differing radii between the inner and outer conductors along its length, the structure radii being in accordance with a function of the structure dielectric constant $\epsilon$ in such manner that the connector has the predetermined characteristic impedance $Z_0$, the insulating structure including a second portion that is closer to the second end than the first portion, the insulating structure second portion extending toward the second end so an end face of the second portion is at a connecting interface with the corresponding coaxial connector.

2. The coaxial connector of claim 1 wherein the radius of the second portion is less than D/2.

3. The coaxial connector of claim 1 wherein the insulating structure includes a first disk like portion and a second portion extending from the disk like portion toward the second end, the first portion having a constant outer diameter equal to D, the second portion having a constant outer diameter less than D.

4. The coaxial connector of claim 3 wherein the connector includes a male end having a pin-shaped inner conductor.

5. The coaxial connector of claim 3 wherein the outer conductor in the vicinity of the second end includes a metal press-fitted ring holding the insulating disk in situ, the ring extending parallel to the inner conductor longitudinal axis toward the second end to an outer conductor interface in the form of an electrical and mechanical reference plane.

6. The coaxial connector of claim 3 wherein all of the insulating structure has the same dielectric constant.

7. The coaxial connector of claim 3 wherein the insulating structure consists of one piece.

8. The coaxial connector of claim 3 wherein the insulating structure second portion extends toward the second end so an end face of the second portion is at a connecting interface with the corresponding coaxial connector.

9. The coaxial connector of claim 3 wherein the connector includes a female end having a bush-shaped inner conductor.

10. The coaxial connector of claim 9 wherein the bush-shaped inner conductor includes a connection interface region including a chuck having a circumference including axial slits.

11. The coaxial connector of claim 3 wherein the connector is a 7/16 coaxial connector, where D is about 16 mm and d is about 7 mm and the predetermined characteristic impedance $Z_0$=50 Ω.

12. The coaxial connector of claim 11 wherein the 7/16 coaxial connector is a 7/16 coaxial male connector.

13. The coaxial connector of claim 11 wherein the 7/16 coaxial connector is a 7/16 coaxial female connector.

14. A coaxial connector comprising an outer conductor having an inner diameter D, an inner conductor coaxial with said outer conductor and having an outer diameter d, the diameters being such that, according to the wave equation, the connector has a predetermined characteristic impedance $$Z_0 = \frac{60}{\sqrt{\epsilon_r}} \ln\left[\frac{D}{d}\right]$$

$Z_0$ where $\epsilon_r$ is the dielectric constant of an insulator between the conductors, the connector having a first end adapted to be connected to a coaxial cable and a second end adapted to be connected to a corresponding coaxial connector, an insulator disk arranged in the region of the second end for supporting the inner conductor, the disk having a bore for guiding the inner conductor, the bore having a diameter less than d, for causing the predetermined characteristic impedance $Z_L$ to prevail in the region of the insulator disk and for equalizing the dielectric properties of the insulator disk, the internal conductor having an external diameter projecting beyond the insulator disk in the direction of the second end, the external diameter being equal to the reduced internal diameter of the bore of the insulator disk, the internal conductor being surrounded by an additional dielectric extending from the insulator disk in the direction of the second end as far as an interface of the internal conductor, the internal conductor having a radial thickness such that the dielectric constant $\epsilon$ thereof causes the predetermined characteristic impedance $Z_L$ to be achieved in accordance with the wave equation.

15. The coaxial connector of claim 14, wherein the connector is arranged so it is a 7/16 coaxial connector, whereby D has a value of approximately 16 mm and d a value of approximately 7 mm and the predetermined characteristic is impedance $Z_L$=50 Ω.

16. The coaxial connector of claim 15, where the 7/16 coaxial connector is a 7/16 coaxial male or female connector.

17. The coaxial connector of claim 14, wherein the dielectric surrounding the internal conductor and the insulator disk are one piece and have the same material as the insulator disk, whereby the dielectric only partially fills the space between internal conductor and external conductor.

18. The coaxial connector of claim 17, wherein the dielectric fills less than one-half of the space between internal conductor and external conductor.

19. The coaxial connector of claim 14, wherein the inner conductor has a pin shape.

20. The coaxial connector according to claim 19, further including a metal ring in an electrical and mechanical reference plane formed by an external conductor interface at the plug-end of the outer connector.

21. The coaxial connector of claim 20, wherein the metal ring is a pressfit ring of claim 14.

22. The coaxial connector of claim 20 wherein the inner connector has a socket shape.

23. The coaxial connector according to claim 22, wherein the socket-shaped inner conductor has a chuck-shaped segment in a region of its second end interface, the chuck shaped part including axial slits distributed radially over the circumference of the chuck shaped segment.

* * * * *